US006390202B1

(12) United States Patent
Heijnen

(10) Patent No.: US 6,390,202 B1
(45) Date of Patent: May 21, 2002

(54) SETTING AN ANNULAR SEAL

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 51 days.

(21) Appl. No.: 09/721,103

(22) Filed: Nov. 22, 2000

(30) Foreign Application Priority Data

Nov. 24, 1999 (EP) ..... 99309379

(51) Int. Cl.[7] ..... E21B 33/10

(52) U.S. Cl. ..... 166/387; 166/63; 277/323; 277/336; 277/609

(58) Field of Search ..... 166/208, 63, 373, 166/387; 277/323, 336, 609, 314, 316, 337

(56) References Cited

U.S. PATENT DOCUMENTS 3,572,768 A * 3/1971 James ..... 228/2.5
4,662,450 A * 5/1987 Haugen ..... 166/181
5,066,029 A * 11/1991 Gill ..... 166/166
5,070,942 A * 12/1991 McInnes ..... 166/115
5,467,822 A 11/1995 Zwart
5,887,660 A 3/1999 Yokley et al.

FOREIGN PATENT DOCUMENTS

EP 0592160 4/1994

OTHER PUBLICATIONS

Foreign Search Report dated Feb. 27, 2001.

* cited by examiner

*Primary Examiner*—David Bagnell
*Assistant Examiner*—Daniel P Stephenson

(57) ABSTRACT

A device is disclosed for setting an annular seal in an annular space formed between a large diameter tubular and a small diameter tubular extending into the large diameter tubular. The device comprises a carrier block suitable to be located at a position in the large diameter tubular proximate said annular space, the carrier block being provided with a carrier ring axially movable relative to the carrier block between a first position and a second position and arranged to axially move the annular seal into the annular space upon movement of the carrier ring from the first to the second position thereof, and further comprising an explosive charge arranged to move the carrier ring from the first position to the second position thereof and a detonator for selectively detonating the explosive charge.

5 Claims, 1 Drawing Sheet

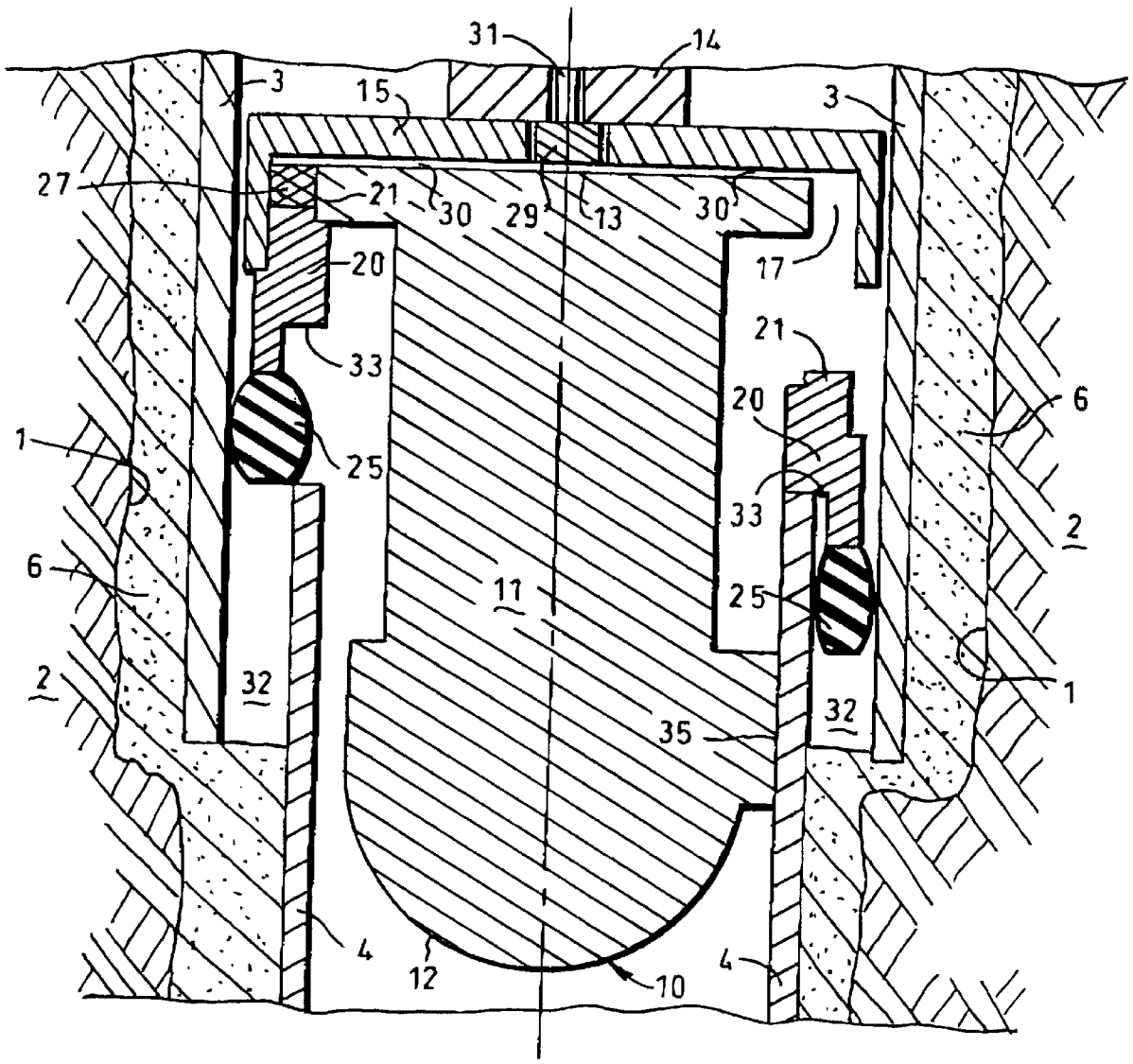
1
2
6
3
14
31
15
27
17
30
13
29
21
20
33
25
32
35
11
10
12
4

SETTING AN ANNULAR SEAL

FIELD OF THE INVENTION

The present invention relates to setting an annular seal. In particular the present invention relates to a device for setting an annular seal in a well that is used for recovering fluids from an underground formation or for storing fluids in an underground formation.

BACKGROUND OF THE INVENTION

Wells used for recovering fluids from underground formations are typically boreholes that are lined with well tubulars in the form of a casing string or a liner. In particular for deep wells, the borehole is drilled in stages, wherein each stage is lined with a casing string that is lowered into the borehole, and wherein the inner diameter of the hole of each next stage is smaller than the inner diameter of the preceding stage(s). Consequently the casing string for a next stage has an outer diameter that is smaller than the inner diameter of the preceding stage(s).

The annular space between two tubulars is called the annular clearance, and the skilled person is able to select the annular clearance that is required under the circumstances in order that the next tubular can be lowered through the preceding tubular(s).

The annular space between the outer surface of a casing string and the inner surface of the borehole is normally filled with cement. The cement can be placed along the entire length of the casing or only along the lower part of the casing.

In order to prevent leakage, the upper end of a next tubular (having a smaller outer diameter) is hung-off in the lower end of the previous tubular (having a larger inner diameter), so that an overlap section is formed. An annular seal is set in the overlap section.

It is an object of the present invention to provide a device for setting the annular seal.

SUMMARY OF THE INVENTION

In accordance with the invention there is provided a device for setting an annular seal in an annular space formed between a large diameter tubular and a small diameter tubular extending into the large diameter tubular, the device comprising a carrier block suitable to be located at a position in the large diameter tubular proximate said annular space, the carrier block being provided with a carrier ring axially movable relative to the carrier block between a first position and a second position and arranged to axially move the annular seal into the annular space upon movement of the carrier ring from the first to the second position thereof, and further comprising an explosive charge arranged to move the carrier ring from the first position to the second position thereof and detonator means for selectively detonating the explosive charge.

BRIEF DESCRIPTION OF THE DRAWING

FIG. 1 shows schematically a longitudinal section of the device according to the invention in two positions.

DETAILED DESCRIPTION

In the specification and the claims the expression "large diameter upper tubular" or "first tubular" will be used to refer to a section of the tubular that has a larger inner diameter, and the expression "small diameter lower tubular" or "second tubular" will be used to refer to a section of the tubular that has a smaller outer diameter. The tubular can be any suitable well tubular, such as a casing or a liner.

The invention is not only applicable in the overlap section, it can also be used as a temporary seal in case a next casing string gets stuck.

The invention will now be described in more detail with reference to the accompanying Figure, which shows schematically a longitudinal section of the device according to the invention in two positions, a first position in which the device is lowered into the borehole (at the left-hand side of the Figure) and a second position in which the seal has been set (right-hand side of the Figure).

FIG. 1 shows a borehole 1 in an earth formation 2. The borehole 1 is lined with a large diameter upper casing 3 and a small diameter lower casing 4. The annulus between the borehole wall and the casings 3 and 4 is filled with cement 6. A casing hanger (not shown) may be present to suspend the lower casing 4.

The device 10 according to the present invention comprises a cylindrical centralizer 11 having a free end 12 and an opposite end 13. The opposite end 13 is provided with a cover 14 with which the device 1 can be attached to the lower end of a string of pipe (not shown) in order to lower the device 10 into the upper casing 3. The pipe can be a drill string, a tubing or a coil tubing.

The device 10 further comprises a carrier block 15 arranged near the opposite end 13 of the cylindrical centralizer 11. The carrier block 15 has an annular recess 17, which has an open end that faces the free end 12 of the cylindrical centralizer 11. The carrier block is suitably an integral part of the cylindrical centralizer 11.

In addition the device 10 comprises a carrier ring 20 slideably arranged on the cylindrical centralizer 11. The carrier ring 20 is provided at one end with an annular rise 21 that can engage with the annular recess 17 and at the opposite end with an annular seal 25.

There is furthermore provided an explosive charge 27, which is arranged in the annular recess 17. The explosive charge 27 has a suitable detonator 29, which detonator 29 communicates with the explosive charge 27 through detonation transfer conduits 30. The detonator 29 is activated by means of an electric signal passed from surface to the device 10 by means of a cable 31, which cable 31 passes through an opening (not referred to by means of a reference numeral) in the cover 14.

During normal operation, the device 10 is lowered at the lower end of a string of pipe (not shown) into the borehole to the required downhole position, so that the lower end of the annular seal 25 touches on the top of the small diameter lower casing 4. This position is shown in the left-hand side of the Figure. In order to set the seal, an electric signal is passed through cable 31 to activate the detonator 29. Activating the detonator 29 causes the explosive charge 27 to explode, and the carrier ring 20 is propelled downwards, pressing the seal 25 into the annular space 32 between the large diameter upper casing 3 and the small diameter lower casing 4. The downward motion of the carrier ring 20 is stopped when the lower surface 33 of the carrier ring is in contact with the upper surface of the small diameter lower casing 4. This is position is shown in the right-hand side of the Figure.

Suitably, the cylindrical centralizer 11 is provided with a plurality of slots 35 arranged near the free end and placed at regular intervals along the circumference of the cylindrical centralizer 11, so as to allow the passage of fluids.

The annular seal 25 can be made of any suitable material, for example a hard rubber, a soft metal or a shape-memory alloy.

Suitably, the inner diameter of the carrier ring 20 is substantially equal to the largest outer diameter of the cylindrical centralizer 11, so that when the device 10 is withdrawn, the annular sealing ring 25 remains in place.

Alternatively the detonator 29 can be activated by means of a battery and a clock mechanism (not shown), or by a signal in the form of a pressure pulse.

The device according to the present invention can as well be used in the well head or in the tubing head of a well.

Suitably the annular seal is made of a shape-memory metal, and wherein the seal is expandable from a primary shape in which the seal has a relatively thin wall thickness to a secondary shape in which the seal has a relatively large wall thickness upon a temperature change of the seal across the transition temperature of the shape-memory metal.

During installation of the seal in the annular space in the way described hereinbefore, the seal is in its primary (thin) shape. Thereafter the temperature of the seal is changed across the transition temperature so that the seal tends to expand to the secondary (thick) shape. Since unrestricted expansion is prevented by virtue of the presence of the two tubulars, part of the seal expansion is translated into the generation of compressive stresses between the seal and the two tubulars. The compressive stresses ensure adequate metal-to-metal sealing between the two tubulars.

We claim:

1. A device for setting an annular seal in an annular space formed between a large diameter tubular and a small diameter tubular extending into the large diameter tubular, the device comprising:

a first tubular having an inside surface defining an inner diameter;

a second tubular having an inside surface defining an inner diameter and an outside surface describing a outer diameter smaller than the inner diameter of said first tubular, said second tubular extending into said first tubular whereby the inside surface of said first tubular and the outside surface of said tubular define an annular space;

a carrier block suitable to be located at a position in the first tubular proximate said annular space, the carrier block being provided with a carrier ring axially movable relative to the carrier block between a first position and a second position and arranged to axially move an annular seal into the annular space upon movement of the carrier ring from the first to the second position thereof, and further comprising an explosive charge arranged to move the carrier ring from the first position to the second position thereof and detonator means for selectively detonating the explosive charge.

2. The device according to claim 1, wherein the carrier block is provided with an annular recess and the carrier ring is provided with an annular rise which engages with the annular recess when the carrier ring is in said first position, and wherein the explosive charge is arranged in the annular recess.

3. The device according to 2, wherein the detonator means is arranged in a central part of the carrier block, and wherein the carrier block is provided with a plurality of detonation transfer conduit providing communication between the detonator means and the explosive charge.

4. The device according to claim 1, further comprising a cylindrical centralizer of diameter substantially equal to the inner diameter of the second tubular and arranged so as to extend into the second tubular when the carrier block is located in said position proximate the annular spacing.

5. The device according to claim 1, wherein the annular seal is made of a shape-memory metal, and wherein the seal is expandable from a primary shape in which the seal has a relatively thin wall thickness to a secondary shape in which the seal has a relatively large wall thickness upon a temperature change of the seal across the transition temperature of the shape-memory metal.

* * * * *